US005813888A

United States Patent [19]

Ozawa

[11] Patent Number: 5,813,888

[45] Date of Patent: Sep. 29, 1998

[54] SYSTEM FOR FLUSHING A WATERCRAFT ENGINE COOLING SYSTEM

[75] Inventor: Sigeyuki Ozawa, Hamamatsu, Japan

[73] Assignee: Sanshin Kogyo Kabushiki Kaisha, Hamamatsu, Japan

[21] Appl. No.: 802,215

[22] Filed: Feb. 19, 1997

Related U.S. Application Data

[63] Continuation of Ser. No. 427,105, Apr. 21, 1995, abandoned.

[30] Foreign Application Priority Data

Apr. 21, 1994 [JP] Japan ..... 6-083437

[51] Int. Cl.[6] ..... B63H 21/32

[52] U.S. Cl. ..... 440/89; 440/38

[58] Field of Search ..... 440/88, 89, 900, 440/111, 112, 113; 114/197, 198, 270, 343, 364; 134/167 A, 167 R, 168 R; 251/149.6; 137/800; 285/901; 138/96 R, 96 T

[56] References Cited

U.S. PATENT DOCUMENTS

| | | | |
|---|---|---|---|
| 2,777,716 | 1/1957 | Gray | 251/149.6 |
| 3,006,311 | 10/1961 | Hansson et al. | 440/112 |
| 4,972,809 | 11/1990 | Hirasawa | 440/111 |
| 4,996,937 | 3/1991 | Niina et al. | 440/111 |
| 5,362,266 | 11/1994 | Brogdon | 440/88 |

FOREIGN PATENT DOCUMENTS

| | | |
|---|---|---|
| 4312889 | 6/1943 | Japan . |
| 286899 | 7/1990 | Japan . |

*Primary Examiner*—Ed Swinehart

*Attorney, Agent, or Firm*—Knobbe, Martens, Olson & Bear LLP

[57] ABSTRACT

A system for flushing the cooling system of the engine in a watercraft is provided, whereby a conduit connected to a source of fresh water is inserted into an adaptor located in the upper body of the watercraft. A self-closing valve is attached to the adaptor for sealing the adaptor, and the conduit automatically opens the valve when it is connected to the adaptor, allowing fresh water to flow through the adaptor and into the cooling jacket of the engine.

14 Claims, 7 Drawing Sheets

SYSTEM FOR FLUSHING A WATERCRAFT ENGINE COOLING SYSTEM

This application is a continuation of U.S. patent application Ser. No. 08/427,105, filed Apr. 21, 1995 now abandoned.

BACKGROUND OF THE INVENTION

This invention is an improved system for flushing the cooling system of an inboard engine mounted within a watercraft.

As is well known in conjunction with most watercraft having inboard engines, the cooling jacket of the engine receives water from the body of water in which the watercraft is operating. After the water has circulated through the cooling jacket, it is dumped back to the body of water in which the watercraft is operating in any of a variety of manners. As a result, the body of water in which the watercraft is operating acts as a large heat exchanger for the engine.

Although this type of cooling system has obvious advantages and offers simplicity, frequently the water in which the watercraft is operating may be such that it could cause contamination to the engine cooling system. This is particularly true when operating in marine environments. Thus, it has been the practice to flush the cooling system with clear water after the watercraft is taken out of use.

The use of water jet propulsion units for powering watercraft is well known and widely accepted. Such units have a variety of advantages over more conventional propeller driven watercraft, such as the ability to run in very shallow water. The typical jet propulsion unit includes a water inlet through which water is drawn from the body of water in which the unit is operating. A portion of the water drawn through the jet propulsion unit is employed to supply cooling water to the cooling jacket of the engine of the watercraft. The water travels through the cooling system and is discharged into the exhaust system of the engine and expelled back into the body of water from which it was drawn.

There is, however, a difficulty with these jet propulsion units. Because of the ability of these units to operate in shallow water, frequently sludge and foreign objects are drawn in through the water inlet. Further, because these units often operate in salt water, salt deposits accumulate in the engine's cooling system and can result in corrosion of the engine. Other obvious disadvantages result from the presence of these substances in the cooling system of the watercraft's engine.

There is therefore a need for an improved means for flushing the cooling system of a watercraft for removal of salt, sludge, and other foreign objects.

Conventionally, watercraft may be provided with some form of externally accessible connection to which a garden hose or the like may be detachably connected for running clear water through the engine cooling jacket. However, these arrangements require some device for closing the fitting when the system is not being flushed. If this system is not closed, then the cooling water will be diverted out of the flushing opening and away from the engine cooling jacket. This provides not only a nuisance, but also a possible source of leakage and potential damage to the engine and its cooling system.

In conjunction with these types of systems, the flushing opening is normally located in the side of the hull and frequently below the water level or at a point close to it when the watercraft is floating in the body of water in which it is operating. This makes it difficult to flush the engine cooling jacket, particularly when the watercraft is still floating in the water.

SUMMARY OF THE INVENTION

The present invention is adapted to be embodied in a small watercraft or the like and comprises an apparatus for facilitating the flushing of a cooling system of an inboard engine mounted within the hull of a watercraft. The apparatus comprises a conduit between the water jacket of the engine and the exterior of the watercraft, a hose for connection to the conduit and to a source of flushing water, and an automatic valve for sealing the conduit automatically when the hose is disconnected from said conduit.

Another feature of the invention is adapted to be embodied in a flushing system for a small watercraft having a hull with a passenger's compartment having a seat therein. In accordance with this feature of the invention, the hose connection is disposed in proximity to the seat and within the rider's compartment so that flushing can be accomplished when the watercraft is still floating in the body of water.

DETAILED DESCRIPTION OF THE PREFERRED EMBODIMENT OF THE INVENTION

Figure 1:
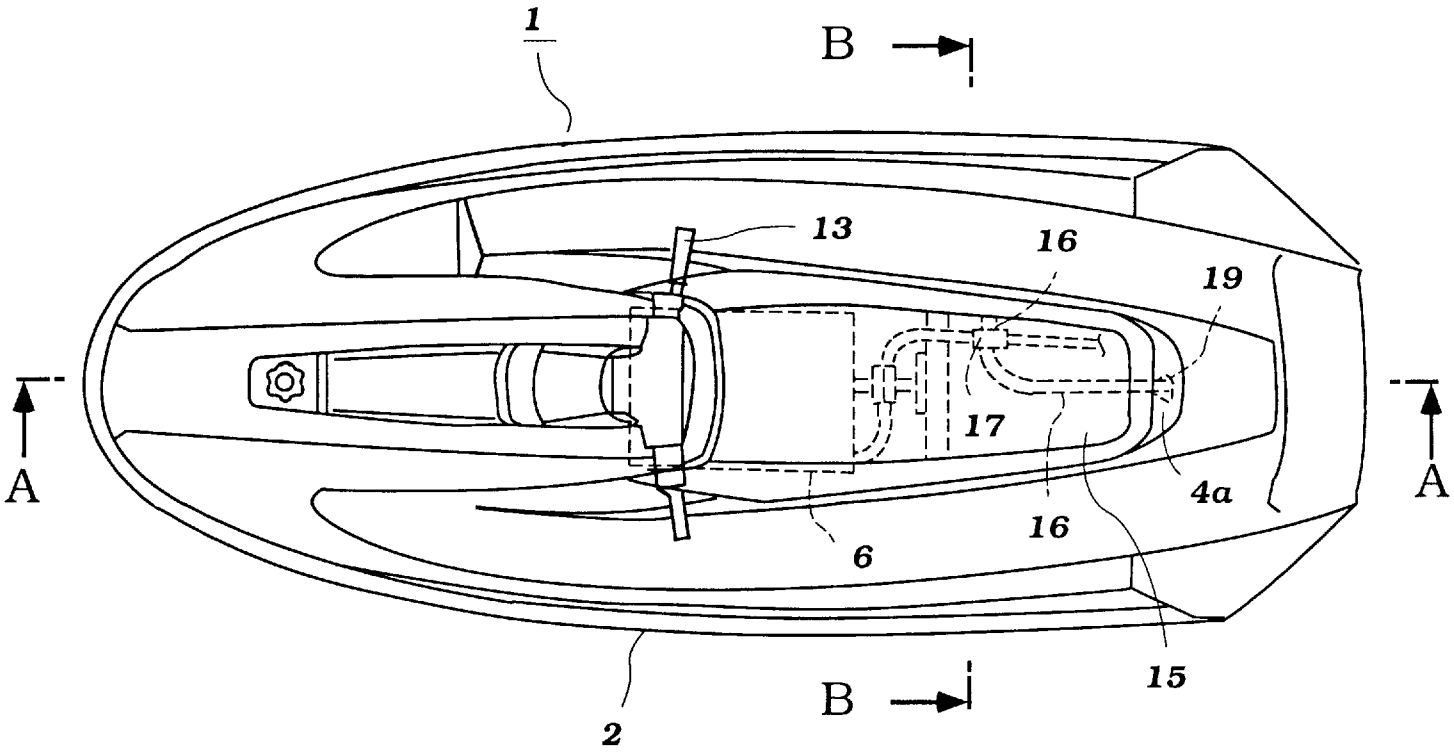
FIG. 1 is a top view of a small watercraft constructed in accordance with the present invention.

Referring first to FIG. 1, a small personal watercraft propelled by a jet propulsion unit is identified generally by the reference numeral 1. The watercraft that is illustrated is one of many types of watercraft which may be powered by a jet propulsion unit and embodying the present invention. For that reason, the construction of the watercraft will be described only generally, inasmuch as those skilled in the art will readily understand how the invention can be utilized with a wide variety of other types of watercraft.

Figure 3:
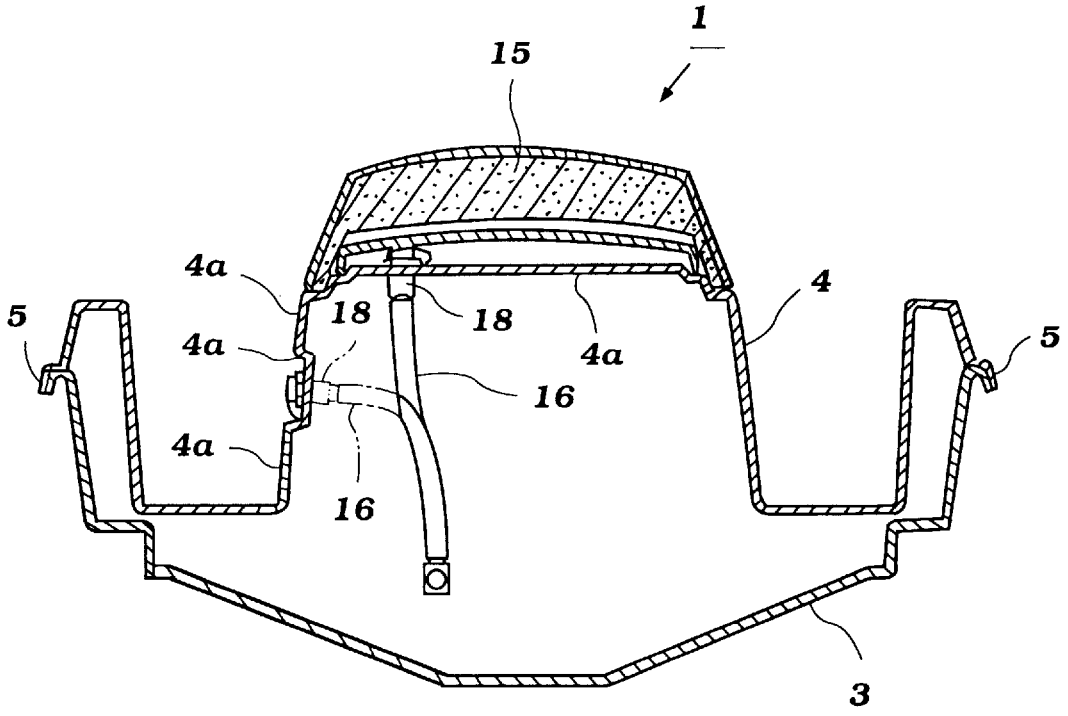
FIG. 3 is a cross-sectional view of the watercraft taken along line B—B of FIG. 1.

The watercraft is comprised of a hull assembly which can be made of one or more parts formed from a material such as a molded fiberglass reinforced resin. As illustrated, the watercraft 1 comprises an upper deck portion 2 and a lower hull portion 3, secured together in a suitable manner, as indicated by reference numeral 5 (FIG. 3). A passenger's area is provided to the rear and center of the watercraft 1, and has a raised seat portion 4 bounded on opposite sides by foot areas. The raised portion 4 accommodates a seat cushion 15 that is designed to accommodate at least one rider seated in a straddle position. The seat cushion 15 is preferably hinged or removable to provide access to the area of the raised area beneath the seat cushion 15. A mast is provided forward the seat 15, and carries a handlebar assembly 13 by which the rider controls the watercraft 1.

Figure 2:
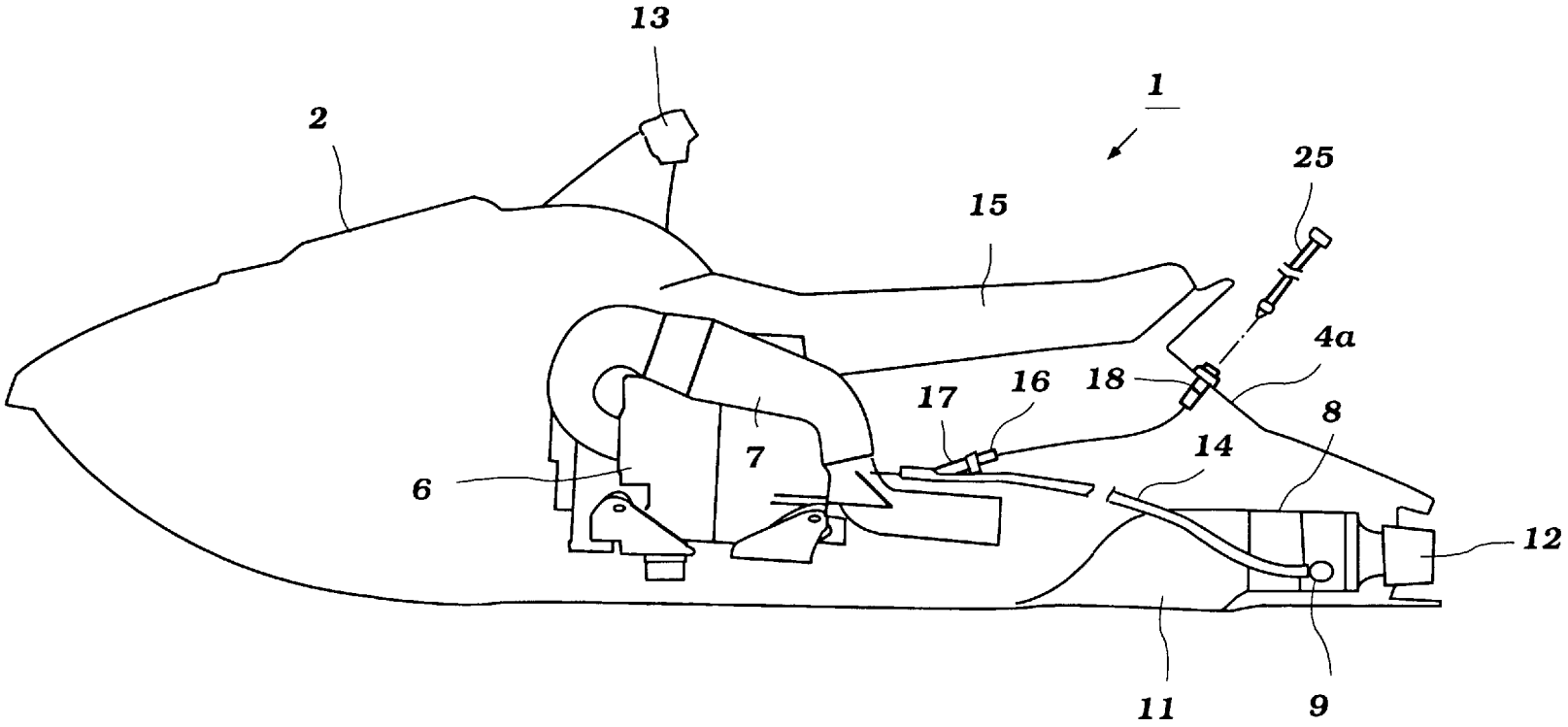
FIG. 2 is a schematic cross-sectional view of the watercraft taken along line A—A of FIG. 1.

As illustrated in FIG. 2, the area immediately forwardly of and beneath the seat cushion 15 contains an internal combustion engine 6, mounted within the hull 2 in a well-known manner. The engine 6 may be of any well-known type, and is depicted as being of the two cylinder in-line type operating on the crankcase compression two cycle principle. It is to be understood however, that various other types of engines may be employed without departing from the invention. The engine 6 is water cooled, with the coolant being delivered to the cooling jacket of the engine 6 from the body of water in which the watercraft 1 is operating, which will be discussed in more detail below.

Beneath the seat cushion 15 and rearwardly of the engine 6, as illustrated in FIGS. 1 and 2, the hull portion 3 is formed with a tunnel in which a jet propulsion unit housing assembly 8 is positioned. The following description of the jet propulsion unit 8 is to be considered typical of only one type of jet propulsion unit 8 which can be used to propel watercraft. Various other types of jet propulsion units may also be readily employed and in fact the invention may be used with conventional propeller-type propulsion systems. The jet propulsion unit 8, however, provides a ready source of pressurized water for the cooling system of the engine 6.

The jet propulsion unit 8 includes a water inlet portion which may be formed in part by the hull 2 and which defines a water inlet opening 11 that communicates with the body of water in which the watercraft 1 is operating. An impeller (not shown) is journalled on an impeller shaft in the jet propulsion unit 8 and is driven by the engine 6 in a known manner. This impeller draws water through the water inlet opening 11 and discharges it rearwardly to a discharge nozzle. A steering nozzle 12 is pivotally supported on the discharge nozzle and extends distally from the jet propulsion unit 8. The steering nozzle 12 is steered by the handlebar assembly 13 in a well-known manner. The jet propulsion housing assembly 8 includes a hose adaptor fitting that is mounted on a straightening vein portion 9 behind the impeller of the jet propulsion unit and which carries water from the jet propulsion unit 8 by means of a flexible conduit 14 to the cooling jacket of the engine 6.

After the water travels through the engine cooling system, it is typically discharged into the exhaust system 7 of the engine 6 and expelled back into the body of water from which it was drawn in any known manner. Because of the ability of jet propulsion units to operate in shallow water, frequently sludge and foreign objects are drawn in through the water inlet. Further, because these units often operate in salt water, salt deposits accumulate in the engine's cooling system and can result in corrosion. To prevent damage to the engine cooling system, fresh water is generally used to flush the cooling system after use of the watercraft 1.

Figure 4:
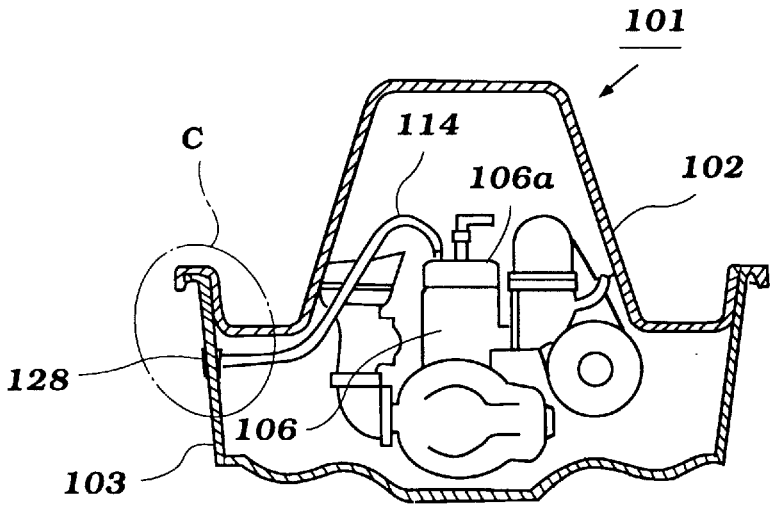
Figure 4 Prior Art
FIG. 4 is a cross-sectional view of an engine flushing system of the prior art.
Figure 5:
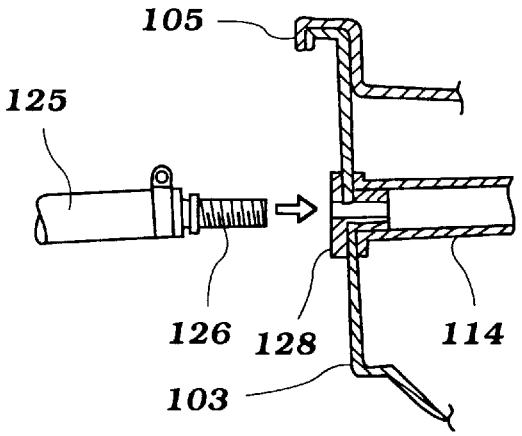
FIG. 5 is a cross-sectional enlarged view of portion C of the flushing system of FIG. 4.

The prior art method of flushing the engine cooling system is illustrated in FIGS. 4 and 5. The watercraft 101 comprising a top portion 102 and bottom hull portion 103 is suitably joined at a point of connection 105. The watercraft 101 is provided with a hose 114 having a connector 128 located on the outside of the hull 103 at one end. At the other end, the hose 114 is connected to the cylinder head 106*a* of the engine 106. FIG. 5 shows an enlarged view of the connector 128. A hose adaptor 125 is provided having a threaded portion 126. The female connector 128 is adapted to receive the threaded portion 126 of the hose adaptor 125. When it is desired to flush the engine cooling system, hose adaptor 125 is inserted into connector 128, and the threaded portion 126 screwed into place. A source of fresh water is connected to the hose adaptor 125, and fresh water is circulated through the adaptor 125, through the hose 114 and into the cylinder head 106*a*. Typically, a cap is provided on the outside of the connector 128 to close the system. This cap must be removed prior to insertion of the hose adaptor 125 and flushing of the system. Should the cap be lost or not properly tightened, the system would remain open and coolant would be lost during operation of the watercraft 101.

Advantageously, the present invention provides an improved hose adaptor which is easily inserted into the body of the watercraft, and which includes an automatic valve for providing a closed system when not being flushed. Referring again to FIGS. 1 and 2, there is provided a clean-out adaptor 18 for flushing the engine cooling system. The flushing fresh water is carried to the engine cooling jacket by means of a flexible conduit or hose 16. A Y-adaptor junction connector 17 joins flexible hose 14 and flexible conduit 16. The Y-adaptor junction connector 17 is in fluid communication with the engine cooling jacket.

The clean-out adaptor 18 can be located under the seat cushion 15, or alternatively, on the side of the raised body portion 4 of the watercraft 1, as shown in FIG. 3.

Figure 6:
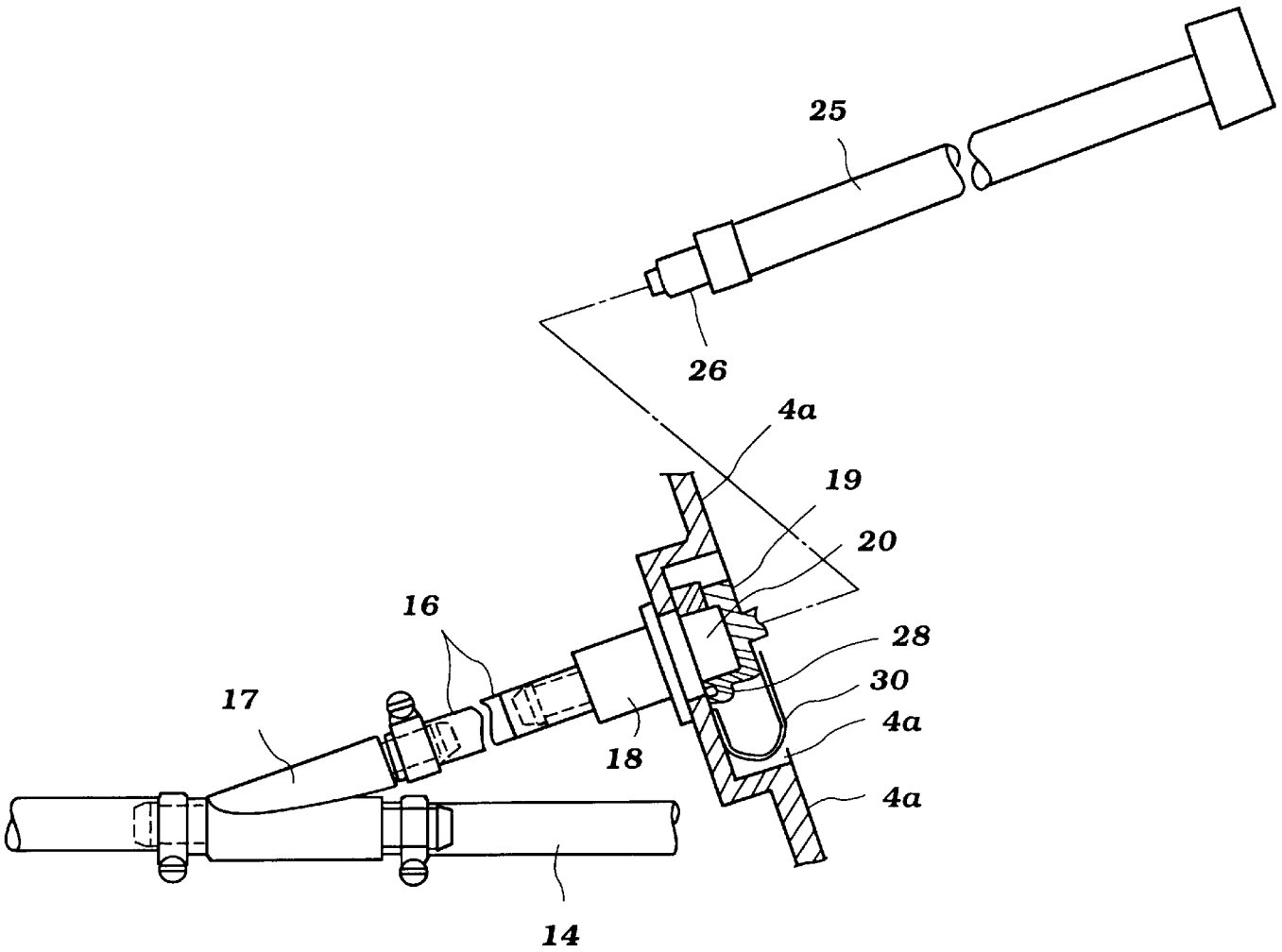
FIG. 6 is an enlarged elevational side view of the hose adaptor and clean-out adaptor of the present invention.

Turning now to FIG. 6, there is shown a bayonet adaptor 26 disposed on the distal end of a hose 25 and cooperative with the clean-out adaptor 18 connected to the flexible conduit 16. The clean-out adaptor 18 is positioned within a S hole through the side of the raised portion 4 of the watercraft 1, such that a portion of the clean-out adaptor 18 remains on the exterior, outer surface in the rider's area of the watercraft 1. To hold the clean-out adaptor 18 in place, the interior portion of the clean-out adaptor 18 preferably has a shoulder or flange which is seated against the interior surface of the watercraft 1 adjacent the hole in which the clean-out adaptor 18 is positioned. The exterior portion of the clean-out adaptor 18 is threaded to receive a clamping nut 28. When tightened, the clamping nut 28 maintains the position of the clean-out adaptor 18 in the side of the watercraft 1.

Figure 8:
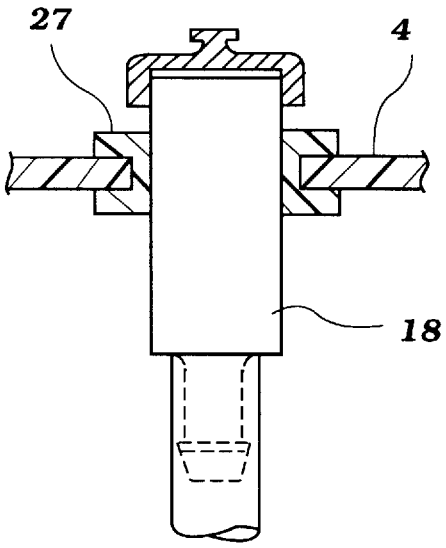
FIG. 8 is a cross-sectional view of an alternative embodiment of the present invention, wherein the clean-out adaptor is held in place with an elastomeric grommet and wherein a separate closure plug is employed.

FIG. 8 illustrates an alternative method for maintaining the clean-out adaptor 18 in the side of the upper body 4 of the watercraft 1. The clean-out adaptor 18 is frictionally held within an elastomeric grommet 27. The inside diameter of the grommet 27 is smaller than the diameter of the cleanout adaptor 18, such that when the clean-out adaptor 18 in inserted into the grommet, the clean-out adaptor 18 is friction fit within the grommet 27.

Turning again to FIG. 6, to access the clean-out adaptor 18, a cap 19 is first removed from the exterior portion of the clean-out adaptor 18 located on the outer surface 4*a* of the upper portion 4 of the watercraft 1. The cap 19 is preferably made of rubber or similar material, such that the cap 19 is retained on the exterior portion of the clean-out adaptor 18 by means of a friction fit. The cap 19 is preferably provided with a retainer strap 30 to avoid loss of the cap 19 after its removal from the clean-out adaptor 18.

Figure 7:
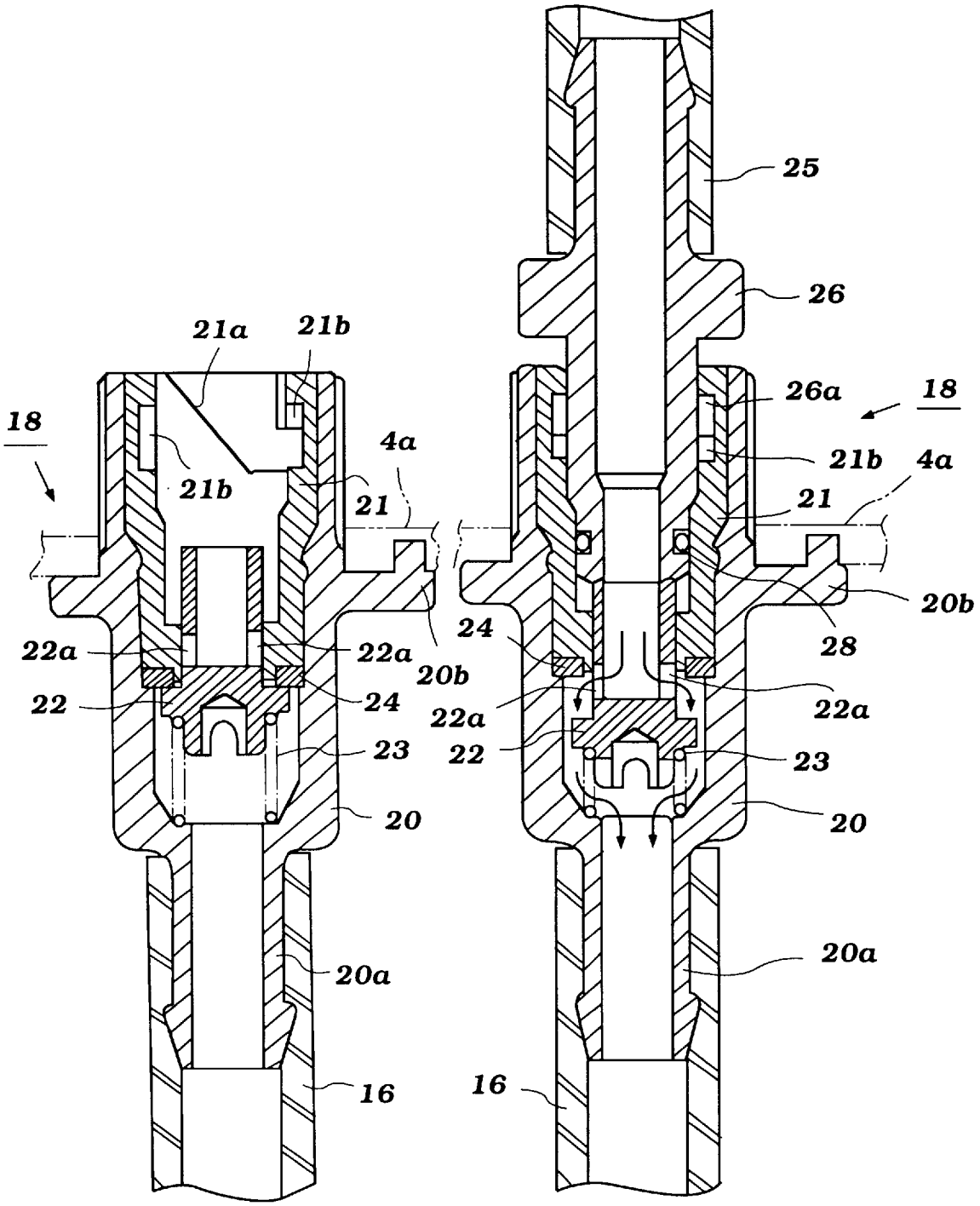
FIG. 7 is a cross-sectional view of the hose adaptor and the clean-out adaptor of the present invention, showing the valve in a normal closed position (FIG. 7 (*a*)) and in an opened, flushing position (FIG. 7(*b*)).

The clean-out adaptor 18 and hose adaptor 26 are illustrated in detail in FIGS. 7(*a*) and 7(*b*). As described above, the clean-out adaptor has an exterior portion 20 which remains on the exterior of the upper body 4*a* of the watercraft 1, and a portion located on the interior of the watercraft 1. The clean-out adaptor 18 is held in place preferably by means of a shoulder or flange 20*b* which is seated against the interior surface of the watercraft 1 adjacent the hole in which the clean-out adaptor 18 is positioned, as illustrated in FIG. 7(*a*). The clean-out adaptor 18 comprises a valve housing 21 which is held in place within the hollow interior of the adaptor exterior portion 20. The distal end 20*a* of the exterior portion 20 has a barb-type fitting which is inserted into the proximal end of the flexible conduit 16 and acts to seal the connection between the exterior portion 20 and the conduit 16. The conduit 16 is then preferably clamped onto the distal end of the hose connector 20*a*, providing a watertight seal between the exterior portion 20 and the hose 16.

The valve housing 21 is held in place within the exterior portion 20 by means of a rib or raised area which fits into a corresponding groove on the interior surface of the exterior portion 20. A moveable valve member 22 is disposed within the interior of the valve housing 21. The valve member 22 comprises a cylindrical upper portion having holes 22*a* located in the sides and a flange located toward the distal end of the valve member 22, and slides freely within the interior of the valve housing 21. A spring 23 is positioned between a shoulder portion located inside hose connector 20 and the shoulder of the valve member 22.

Sealing washer 24 is engaged between a shoulder on the inside diameter of the hose connector 20 and the lower end of the valve housing 21, thereby forming a valve seat between the valve housing 21 and the valve member 20, and preventing the flow of water through the valve housing 21 when the valve 22 is closed (FIG. 7(*a*)). The valve further provides a self-closing function, with the spring 23 biasing the flange of the valve member 22 into sealed engagement with the sealing washer 24, preventing the loss of coolant from the engine cooling system when the clean-out adaptor 18 and the hose adaptor 26 are disengaged.

To assemble the valve, the spring 23 is placed on the shoulder portion of the interior of hose connector 20. The moveable valve member 22 is then positioned on top of the spring 23. The sealing washer 24 is placed on top of the flange portion of the valve member 22, and the valve housing 21 is slid over the cylindrical portion of the valve member 22 and the rib snapped into the corresponding groove in the hose connector, thereby clamping the washer 24 between the flange on the valve member 22 and the distal portion of the valve housing 21 to form the seal. The valve remains closed when the spring 23 biases the flange on the valve member 22 against the washer 24.

An open-valve condition is illustrated in FIG. 7 (*b*). The hollow hose adaptor 26 has a bayonet portion comprised of a pair of lugs 26*a* at its distal end. The bayonet adaptor 26 is inserted into the exterior portion of the clean-out adaptor 18 and into the hollow interior of the valve housing 21. The bayonet adaptor lugs 26*a* on opposite sides fit within two corresponding L-shaped grooves 21*b* located on the interior surface of the valve housing 21. The bayonet adaptor 26 is inserted into the valve housing 21 such that the lugs 26*a* slide into the grooves 21*b*. After the bayonet adaptor 26 is positioned within the valve housing 21, the adaptor 26 is turned, such that the lugs 26*a* slide into the bottom portion of the grooves 21*b* and the adaptor 26 in locked in place.

When the adaptor 26 is locked in place, the distal end of the adaptor 26 contacts the proximal end of the cylindrical portion of the valve member 22 and moves it inwardly, thereby compressing the spring 23 such that the holes 22*a* in the valve member 22 are pushed past the sealing washer 24. This allows fluid to flow through the hose connector 25, through a bore in the bayonet adaptor 26, through the cylindrical portion of the valve member 22, through the holes 22*a*, past the sealing member 24, and into the interior of the distal end of the hose connector 20*a* which is in fluid communication with the conduit 16. An o-ring 28 is preferably disposed on the distal end of the bayonet adaptor 26 to form a seal between the adaptor 26 and the interior of the valve housing 21.

The present invention therefore provides a clean-out adaptor 18 positioned on the upper surface of the watercraft 1 having a valve which is automatically actuated when the hose adaptor 25 and bayonet adaptor 26 are connected to the flushing adaptor 18. This provides a closed engine cooling system and means for easily accessing the engine cooling system to provide a source of fresh water for flushing the system after use.

It should be readily apparent that the foregoing description is that of a preferred embodiment of the invention and that various changes and modifications may be made without departing from the spirit and scope of the invention as defined by the appended claims.

We claim:

1. A jet propelled watercraft having a hull, an engine mounted within said hull, a water jet propulsion unit driven by said engine for propelling said watercraft by pumping water from a body of water in which said watercraft is operating, said engine having a cooling system, said hull defining a rider's compartment, said cooling system including a cooling jacket, a coolant conduit for delivering a portion of the water pumped by said jet propulsion unit to said cooling jacket, a flushing conduit extending from said coolant conduit and terminating in an end disposed in a portion of said hull, means for providing a detachable connection between a flushing hose and a flushing conduit end for flushing both said cooling system and said jet propulsion unit with fresh water.

2. The watercraft of claim 1, wherein the conduit end is provided with an automatically operated valve maintained in a closed position until a hose is detachably connected thereto.

3. The watercraft of claim 2, wherein the conduit end is disposed on one side of a raised area formed centrally in the rider's area.

4. The watercraft of claim 3, further including a seat cushion supported on said raised portion and adapted to accommodate a rider seated in straddle fashion.

5. The apparatus of claim 4, wherein the conduit end is disposed beneath the seat cushion.

6. The watercraft of claim 1, wherein the flushing conduit end is disposed beneath a selectively removable closure closing an opening in the hull.

7. A watercraft comprised of a hull defining a rider's compartment, an engine mounted within said hull and having a cooling system including a cooling jacket, a conduit extending from said cooling jacket and terminating in the passenger's area of said hull, and means for providing a detachable connection between a flushing hose and the conduit end within said passenger's area, said conduit end being disposed on one side of a raised area formed centrally in said rider's compartment.

8. The watercraft of claim 7, further including a seat cushion supported on said raised portion and adapted to accommodate a rider seated in straddle fashion.

9. The apparatus of claim 8, wherein the conduit end is disposed beneath the seat cushion.

10. The watercraft of claim 8, wherein the conduit end is disposed at an upstanding side of the raised portion in proximity to the seat cushion.

11. A watercraft comprised of a hull defining a rider's compartment, an engine mounted within an engine compartment defined within said hull and having a cooling system including a cooling jacket, means for circulating water from the body of water in which said watercraft is operating through said engine cooling jacket and back to said body of water for cooling of said engine, said hull being provided with a surface portion extending above a longitudinally extending cavity formed in said hull and in proximity to said rider's area, a flushing conduit extending from a first end portion supported on said hull surface portion to a second end portion in communication with said engine cooling system for introducing flushing cooling water through said engine cooling system, and means providing a cover over said hull surface portion for normally concealing said first end portion of said flushing conduit.

12. The watercraft of claim 11, wherein the cover comprises a seat positioned in the passenger's compartment.

13. The watercraft of claim 11, wherein the longitudinally extending hull cavity underlying the hull surface portion comprises at least in part an engine compartment that is disposed adjacent an opening in the hull surface portion through which the engine may be access for servicing.

14. The watercraft of claim 11, wherein the engine drives a jet propulsion unit for propelling the watercraft and wherein the means for circulating liquid from the body of water in which the watercraft is operating through the engine cooling jacket includes a conduit extending between said jet propulsion unit and said cooling jacket, said flushing conduit intercepting said conduit for flushing of both of said jet propulsion unit and said cooling jacket.

* * * * *